US008397688B2

(12) United States Patent
Cunningham

(10) Patent No.: US 8,397,688 B2
(45) Date of Patent: Mar. 19, 2013

(54) CAM COVER

(75) Inventor: Robert R. Cunningham, Clawson, MI (US)

(73) Assignee: LANXESS Corporation, Pittsburgh, PA (US)

( * ) Notice: Subject to any disclaimer, the term of this patent is extended or adjusted under 35 U.S.C. 154(b) by 0 days.

(21) Appl. No.: 12/637,125

(22) Filed: Dec. 14, 2009

(65) Prior Publication Data

US 2010/0089359 A1 Apr. 15, 2010

Related U.S. Application Data

(63) Continuation of application No. 11/656,669, filed on Jan. 23, 2007, now Pat. No. 7,654,237.

(51) Int. Cl.
*F01M 9/10* (2006.01)

(52) U.S. Cl. ..... 123/90.38; 123/195 C

(58) Field of Classification Search ..... 123/90.38, 123/90.39, 195 C, 193.3, 193.5
See application file for complete search history.

(56) References Cited

U.S. PATENT DOCUMENTS

| | | | | |
|---|---|---|---|---|
| 4,402,518 | A | 9/1983 | Locacius | 277/166 |
| 4,423,707 | A | 1/1984 | Sihon et al. | 123/196 R |
| 4,625,581 | A | 12/1986 | Hull | 74/606 R |
| 4,898,261 | A | 2/1990 | Winberg et al. | 184/6.22 |
| 4,930,469 | A | 6/1990 | Kamprath et al. | 123/195 C |
| 4,938,314 | A | 7/1990 | Sitzler et al. | 184/1.5 |
| 5,083,537 | A | 1/1992 | Onofrio et al. | 123/175 R |
| 5,190,803 | A | 3/1993 | Goldbach et al. | 428/138 |
| 5,375,569 | A | 12/1994 | Santella | 123/90.38 |
| 5,842,265 | A | 12/1998 | Rink | 29/460 |
| 5,940,949 | A | 8/1999 | Rink | 29/33 K |
| 6,085,709 | A * | 7/2000 | Freese | 123/90.38 |
| 6,131,543 | A | 10/2000 | Achenbach et al. | 123/195 C |
| 6,216,659 | B1 | 4/2001 | Takegami | 123/193.5 |
| 6,584,950 | B1 | 7/2003 | Cunningham | 123/195 C |
| 6,923,998 | B2 | 8/2005 | Forry et al. | 427/183 |
| 7,654,237 | B2 * | 2/2010 | Cunningham | 123/90.38 |

* cited by examiner

*Primary Examiner* — Ching Chang
(74) *Attorney, Agent, or Firm* — Nicanor A. Kohncke

(57) ABSTRACT

Cam covers including a shell of the plastic material reinforced with a support structure and one or more end caps and methods for making cam covers incorporating a plastic shell and a metal or plastic support structure and one or more end caps are described herein.

18 Claims, 7 Drawing Sheets

CAM COVER

This application is a continuation of U.S. patent application Ser. No. 11/656,669, filed Jan. 23, 2007, incorporated herein by reference.

BACKGROUND

Reducing the weight of a mechanical apparatus is often desirable for reasons including, for example, ease of transport, ease of installation, and improved fuel efficiency. In the automotive industry one approach to reducing the overall weight of the vehicle has involved replacing various structural metal components, such as metal body panels, with lighter weight plastic components. More recently, attention in the automotive industry has turned towards replacing metal components of the engine with molded plastic. However, a molded plastic engine component must provide at least the same degree of mechanical strength and rigidity as the metal component that it is replacing, as well as resist the heat and fluids associated with an internal combustion engine. In addition, dimensional stability is very important for some classes of sensors that are attached to such parts. This latter problem is particularly difficult for polymer materials due to their relatively high coefficient of thermal expansion.

Therefore, it is desirable to develop a molded plastic cam cover for use as a component in the engine of an automobile. In addition to reduced weight, the molded plastic cam cover described herein has strength and rigidity and dimensional accuracy that is at least equivalent to that of a metal valve cover.

SUMMARY

Embodiments of the invention presented herein include a cam cover including a shell of a plastic material having a top cover and sidewalls extending substantially downward from the top cover and a support structure including a base, inner edges, and outer edges. The shell has an exterior surface and an interior surface, and the interior surface defines a hollow interior having an open bottom opposite the top cover. At least a portion of the shell is fixedly attached to at least a portion of the support structure. In some embodiments, the support structure includes at least one perforation and at least a portion of the shell may extend through the at least one perforation. In other embodiments, at least a portion of the inner edges, outer edges, or combination thereof of the support structure may be embedded in the shell. The shell of embodiments may be fixedly attached to the support structure by means including, but not limited to, fasteners, adhesives, snap connectors, and combinations thereof, or attachment means may be used in combination with the at least one perforation described above.

In various embodiments, the shell may be made from any plastic material including thermoset plastic, thermoplastic, and combinations thereof, and in some embodiments, the thermoplastic material may be selected from thermoplastic polyurethane, thermoplastic polyurea, thermoplastic polyimide, thermoplastic polyamide, thermoplastic polyamideimide, thermoplastic polyester, thermoplastic polycarbonate, thermoplastic polysulfone, thermoplastic polyketone, thermoplastic polypropylene, thermoplastic acrylonitrile-butadiene-styrene, and mixtures and co-polymers thereof. In certain embodiments, the plastic material of the shell may be reinforced with a reinforcement material such as, but not limited to glass fibers, carbon fibers, metal fibers, polyamide fibers, and mixtures thereof selected from thermoset plastic, thermoplastic, and combinations thereof. In certain embodiments, the plastic material of the shell may further include a reinforcement material such as, but not limited to, glass fibers, carbon fibers, metal fibers, polyamide fibers, and mixtures thereof.

In embodiments, the shell may further include a flanged portion having a lower flange and an upper flange. The lower flange extends substantially laterally from the sidewalk and provides a means by which the cam cover attaches to an engine. The upper flange extends substantially laterally from the sidewalls of the shell and may be continuous with the lower flange, abutting the support structure. In some embodiments, the support structure may be fixedly attached to the upper flange. In other embodiments, the interior surface of the shell and an outer surface of the lower flange may be continuous, and in still other embodiments, the lower flange may further include a gland and a sealing means where the sealing means may be a gasket or o-ring in the gland.

The flanged portion may also include at least one flange aperture, and the base of the support structure may further include at least one perforation. In particular embodiments, the at least one perforation of the base may be aligned with the at least one flange aperture to make a connector aperture, and the connector aperture may be continuous with an engine aperture on the engine such that a connector means may be passed through the connector aperture. In some embodiments, the at least one connector aperture may further include compression limiters.

At least one reinforcement rib may be dispersed on, or around, an exterior surface of the shell sidewalls in embodiments, and at least a portion of the at least one reinforcement rib may be continuous with the sidewalls and extend substantially downward and laterally to the support structure, In some embodiments, the support structure may further include at least one perforation, and at least a portion of the shell may extend through the at least one perforation connecting the shell to the at least one reinforcement rib.

In various embodiments, the support structure may further include at least one end cap disposed on an end of the shell, and the end cap may have a base, end cap sidewalls extending upward from the base, and edges defining a perimeter of at least a portion of the end cap. The end cap may define at least a portion of the hollow interior of the cam cover. The end cap may further include at least one perforation. The end cap may abut the support structure such that at least a portion of the base of the support structure and at least a portion of the base of the end cap are continuous. In some embodiments, at least a portion of the shell may extend through the at least one perforation of the end cap and at least a portion the edges may be embedded in the plastic material. The end cap may also include at least one reinforcement rib of a plastic material dispersed along the end cap sidewalls. In particular embodiments, at least a portion of the shell may extend through the at least one perforation of the end cap connecting the shell to the at least one reinforcement rib. In some embodiments, the support structure may include at least one perforation and the at least one reinforcement rib may be connected to the shell through the at least one perforation of the end cap and may further be connected to the shell by a portion of shell extending though the at least one perforation of the support structure. In other embodiments, at least a portion of the at least one reinforcement rib may be continuous with the sidewalls of the shell.

The cam cover may further include at least one sensor and/or an alternator disposed on the shell in some embodiments, and the sensor and/or alternator may be fixedly attached to the cam cover by self tapping screws screwed into the shell in other embodiments.

In embodiments, the cam cover may include an insert pressed onto the interior surface of the shell.

In particular embodiments, the interior surface of the shell may include one or more interior reinforcement ribs that may be continuous with at least a portion of the shell.

In certain embodiments, the support structure may be made of a metallic material.

The invention presented herein may also include an engine having cams, rockers and/or valves, and a cam cover covering the cams, rockers and/or valves. The cam cover may include a shell of a plastic material having a top cover and sidewalls extending substantially downward from the top cover and a support structure including a base, inner edges, and outer edges. The shell has an exterior surface and an interior surface, and the interior surface defines a hollow interior having an open bottom opposite the top cover. At least a portion of the shell may be fixedly attached to at least a portion of the support structure. In some embodiments, the support structure may include at least one perforation and at least a portion of the shell may extend through the at least one perforation. In other embodiments, at least a portion of the inner edges, outer edges, or combination thereof of the support structure may be embedded in the shell. The shell of embodiments may be fixedly attached to the support structure by means including, but not limited to, fasteners, adhesives, snap connectors, and combinations thereof, or attachment means may be used in combination with the perforations as described above. The cam cover of embodiments may further any of the embodiments described above.

Other embodiments of the invention include an automobile including an engine having cams, rockers and/or valves, and a cam cover covering the cams, rockers and/or valves. The cam cover may include a shell of a plastic material having a top cover and sidewalls extending substantially downward from the top cover and a support structure including a base, inner edges, and outer edges. The shell has an exterior surface and an interior surface, and the interior surface defines a hollow interior having an open bottom opposite the top cover. At least a portion of the shell is fixedly attached to at least a portion of the support structure. In some embodiments, the support structure may include at least one perforations and at least a portion of the shell may extend through the at least one perforations. In other embodiments, at least a portion of the inner edges, outer edges, or combination thereof of the support structure may be embedded in the shell. The shell of embodiments may be fixedly attached to the support structure by means including, but not limited to, fasteners, adhesives, snap connectors, and combinations thereof. or attachment means may be used in combination with the perforations as described above. The cam cover of embodiments may further any of the embodiments described above.

DESCRIPTION OF DRAWINGS

For a fuller understanding of the nature and advantages of the present invention, reference should be made to the following detailed description taken in connection with the accompanying drawings, in which.

DETAILED DESCRIPTION

Before the present compositions and methods are described, it is to be understood that this invention is not limited to the particular processes, compositions, or methodologies described, as these may vary. It is also to be understood that the terminology used in the description is for the purpose of describing the particular versions or embodiments only, and is not intended to limit the scope of the present invention which will be limited only by the appended claims.

It must also be noted that as used herein and in the appended claims, the singular forms "a", "an", and "the" include plural reference unless the context clearly dictates otherwise. Thus, for example, reference to a "cam cover" is a reference to one or more cam covers and equivalents thereof known to those skilled in the art, and so forth. Unless defined otherwise, all technical and scientific terms used herein have the same meanings as commonly understood by one of ordinary skill in the art. Although any methods and materials similar or equivalent to those described herein can be used in the practice or testing of embodiments of the present invention, the preferred methods, devices, and materials are now described. Nothing herein is to be construed as an admission that the invention is not entitled to antedate such disclosure by virtue of prior invention.

As used herein, the term "about" means plus or minus 10% of the numerical value of the number with which it is being used. Therefore, about 50% means in the range of 45%-55%. Unless otherwise indicated, all numbers or expressions, such as those expressing structural dimensions, quantities of ingredients, etc. used in the specification and claims are understood as modified in all instances by the term "about."

The present invention is directed to a cam cover that may be used with an engine, such as, for example, an internal combustion engine. The cam cover generally includes a shell of plastic material and a support structure fixedly attached to the exterior surfaces and/or the interior surfaces of the shell. In embodiments, a portion of the plastic material of the shell may extend through perforation having edges in the support structure, and the plastic material may cover at least a portion of the edges of the perforation. In other embodiments, edges of the support structure may be embedded in the plastic material. Therefore, the support structure may be fixedly attached to the shell because portions of the support structure are embedded in the plastic material of the shell. The cam cover of various embodiments may generally be fixedly attached to an external surface of an engine and house and/or cover valves, cams, rockers, or combinations, thereof, of the engine.

The cam cover may also provide a surface for attaching engine components, such as, for example, sensor or alternator, to the engine.

Figure 1:
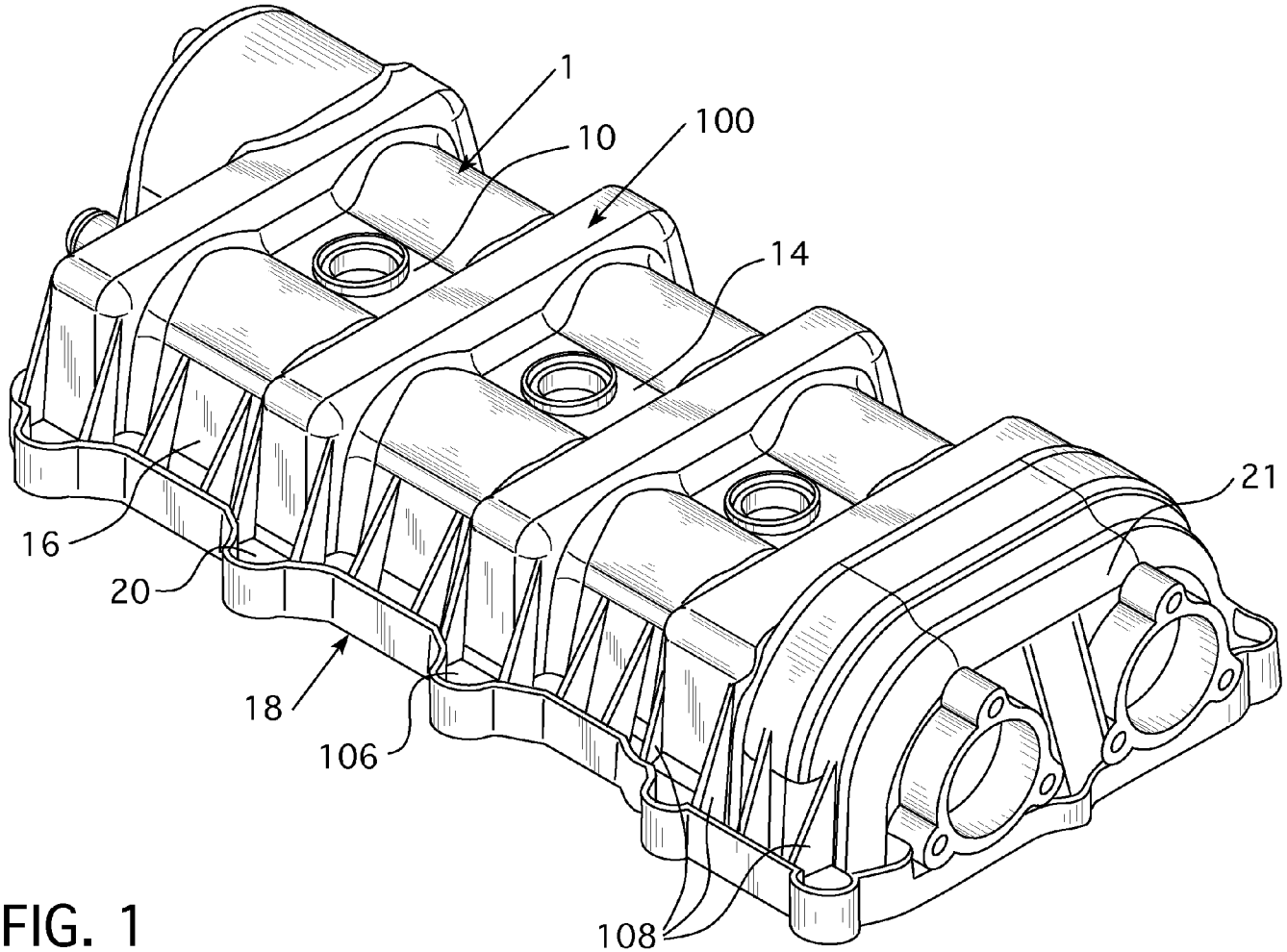
FIG. 1 illustrates a top view of a molded plastic cam cover.
Figure 2:
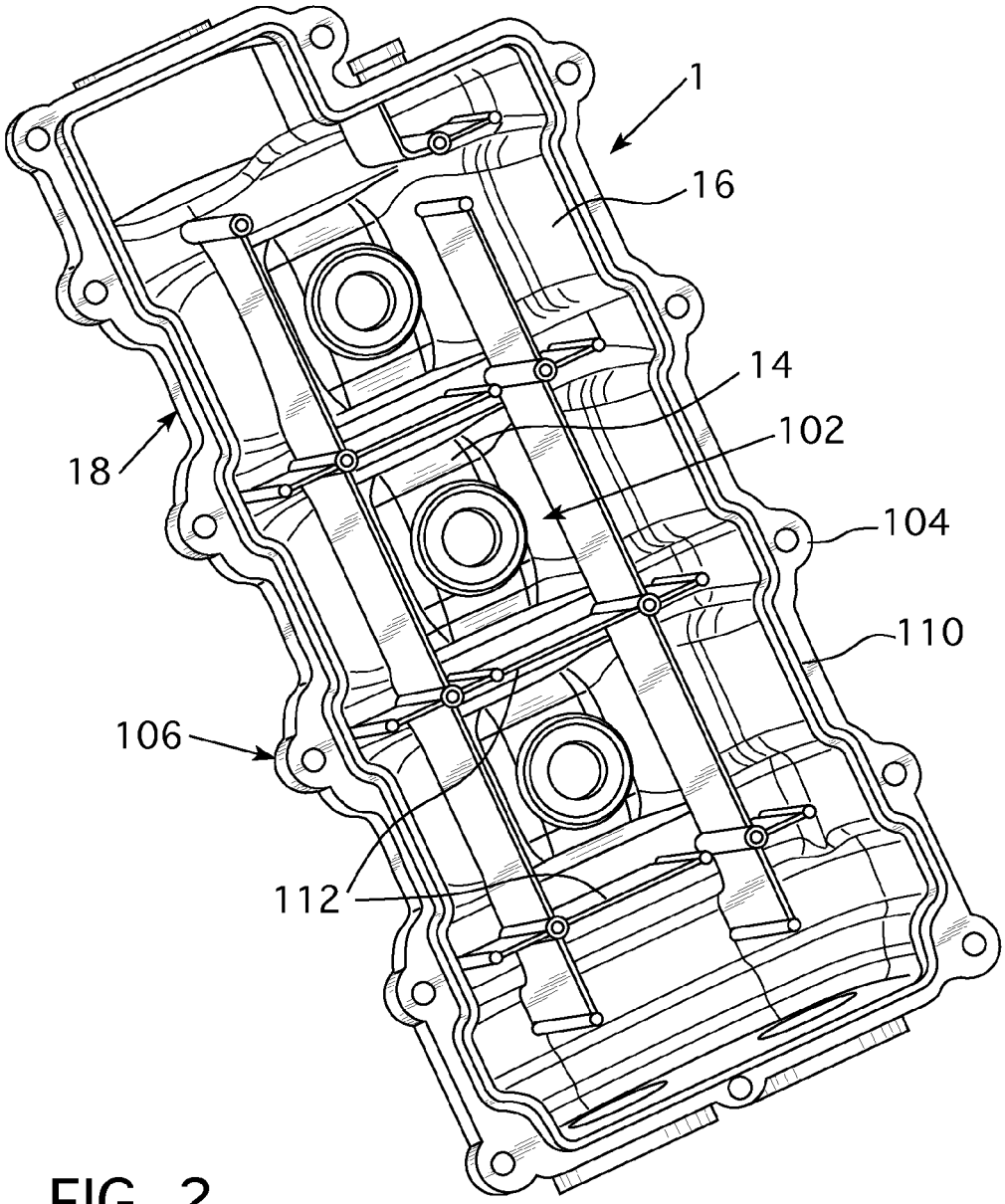
FIG. 2 illustrates a bottom view a molded plastic cam cover.

FIGS. 1 and 2 illustrate one example of a cam cover 1 of the invention: FIG. 1 showing external surfaces of the cam cover 1, and FIG. 2 showing internal surfaces of the cam cover. The cam cover 1 generally includes a shell 10, support structure 20, and end cap 21. The shell 10 includes a top covering 14 and sidewalls 16 extending downward from the top covering 14 such that the top covering 14 is continuous with the sidewalls 16. The sidewalls 16 and top covering 14 may each have an external surface 100 and internal surface 102: the external surface 100 being exposed to the external environment of the engine, and the internal surface defining a hollow interior wherein the surface opposite the top covering is open.

In some embodiments, the sidewalls 16 may further include a flanged portion 18 of the shell 10 extending substantially laterally from, and being continuous with, the sidewalls 16 of the shell 10 and being molded from the plastic material of the shell 10. A lower flange 104 may provide a means by which the cam cover attaches to an engine, and an upper flange 106 may abut the support structure 20 and/or end cap 21. In some embodiments, the upper flange 106 may abut the shell and join the shell 10 to the support structure 20 or end cap 21.

The shell 10 may further include a plurality of reinforcement ribs 108 on the external 100 surface of the shell and/or the internal 102 surface of the sidewalls 16 and/or top covering 14 that functions to reinforce the plastic structures of the shell and provide improved structural rigidity and dimensional stability to the shell. The reinforcement ribs may be further joined to the flanged portion of the shell 18.

In various embodiments, the shell 10 is joined to the support structure 20 and/or end cap 21 by providing plastic material that extends through perforations in the support structure 20 or end cap 21 and covering at least a portion of the edges of the perforation. In some embodiments, the plastic material of the upper flange 106 may extend through the perforation and be continuous with one or more reinforcement ribs 108. In other embodiments, the flanged portion 18 of the shell may cover the outer edges of the support structure embedding at least a portion of the outer edge in the plastic material.

In particular embodiments, the top covering 14, sidewalls 16, and the flanged portion of the shell 18 are continuous with, and formed from, the plastic material of the shell 10, such that no joints and/or breaks are present on any of the interior surfaces 102 of the shell 10, wherein the shell 10 includes the top covering 14, sidewalls 16, and flanged portion of the shell 18. Without wishing to be bound by theory, the absence of joints and/or breaks in the interior surface of the shell 10 may allow for the cam cover 1 to provide a barrier to fluids on the interior surface of the cam cover, such as, for example, oil or lubricant from the valves, cams, rockers or combination of these. At the same time, the cam cover may provide an effective barrier to elements from the external parts of the engine, such as, for example, water, dirt, and debris.

Figure 3:
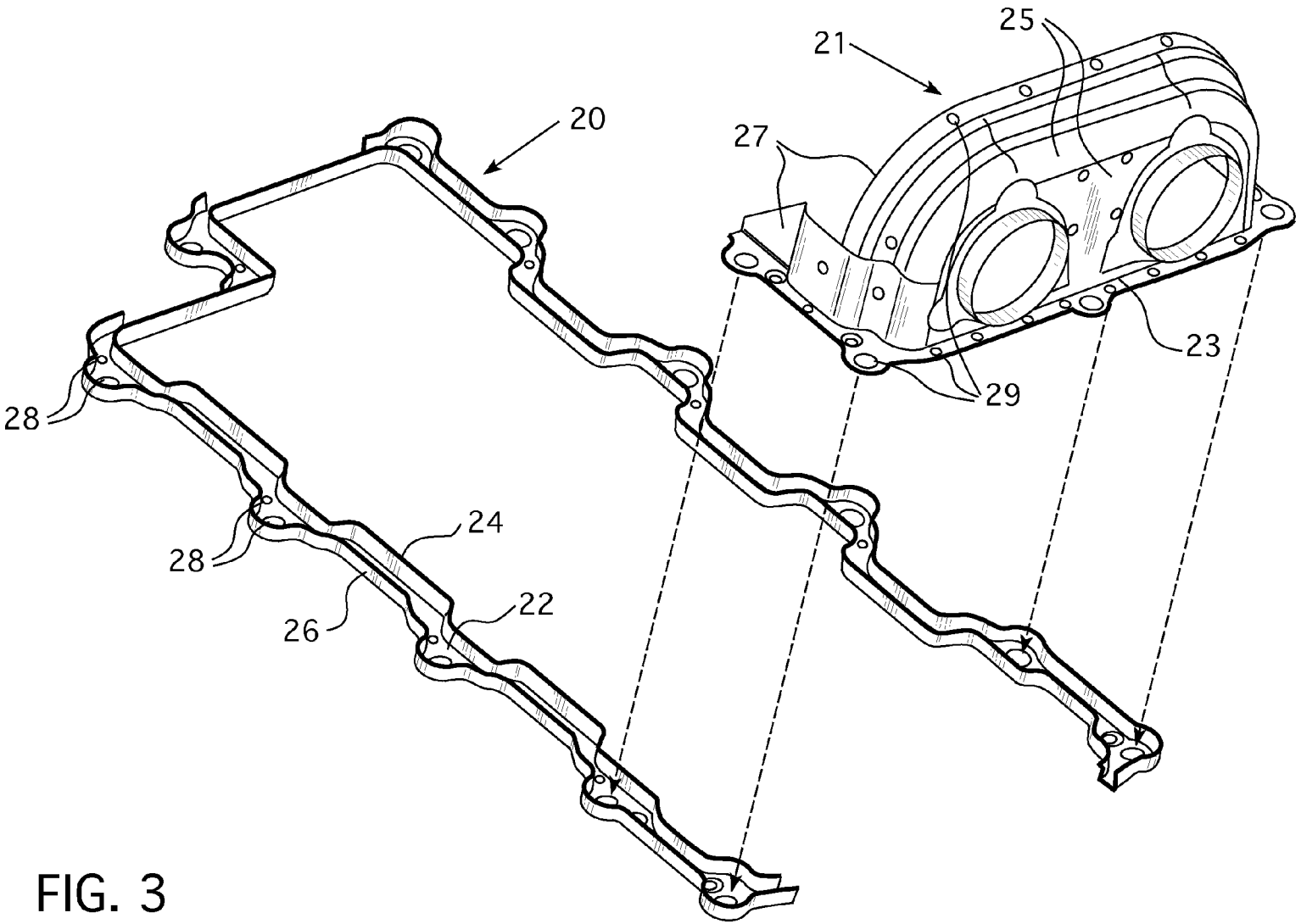
FIG. 3 illustrates a support structure and an end cap for a molded plastic cam cover.

FIG. 3 illustrates one example of a support structure 20 including a base 22, inner edges 24, and outer edges 26 extending substantially upward from the base and defining a depression within the support structure. The support structure 20 may contain a plurality of perforations 28. In some embodiments, the support structure may further include one or more end cap 21 including a base 23, sidewalls 25 extending substantially upward from the base, and end cap edges 27 defining a perimeter of at least a portion of the end cap. The end cap 21 may also include a plurality of perforations 29. The sidewall of the end cap 25 may define at least a portion of the interior surfaces of the shell 10. As illustrated in FIG. 3, the end cap 21 may be disposed on an end of the support structure 20 and abut the support structure 20 such that at least a portion of the base of the end cap 23 and the base of the support structure 22 are joined forming a continuous support structure. The support structure 20 and end cap 21 may be made of the same material, for example, a metallic material, a plastic material, or in some embodiments, the support structure and the end cap may be made of different materials.

Figure 4:
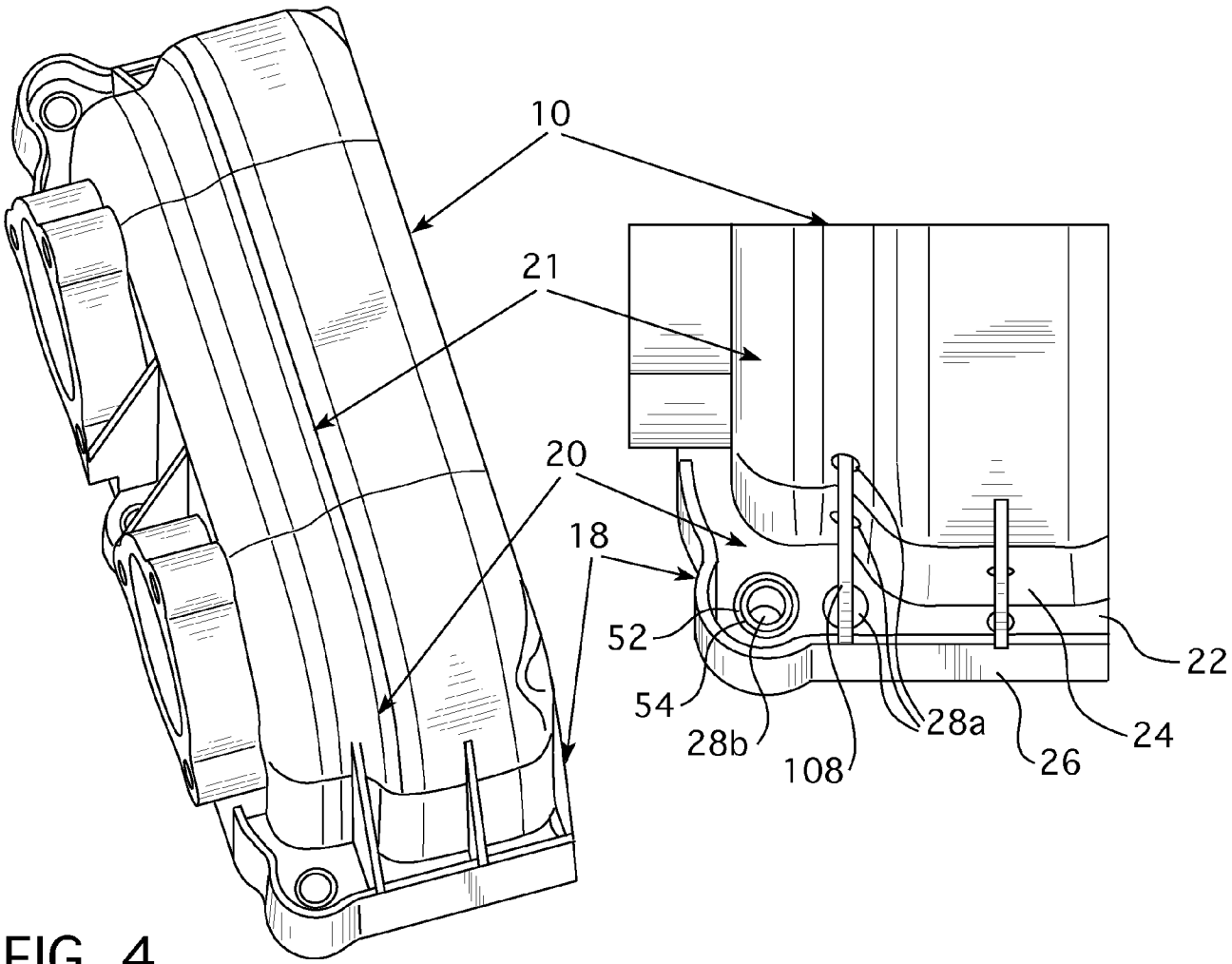
FIG. 4 illustrates an expanded view of a portion of a molded plastic cam cover.
Figure 5:
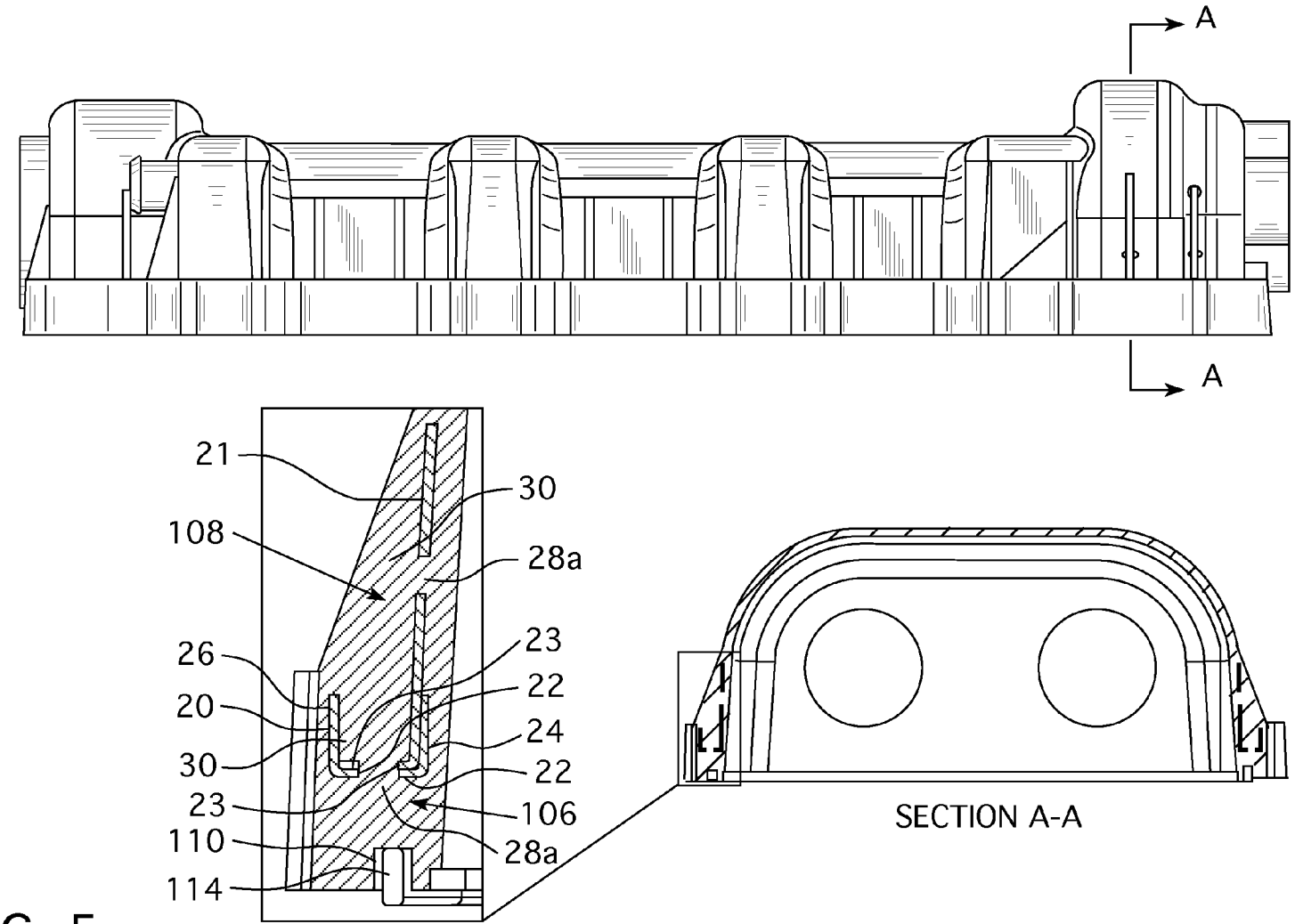
FIG. 5 illustrates a section representation of a cross section of a molded plastic cam cover including a gland and gasket and a support structure.
Figure 6:
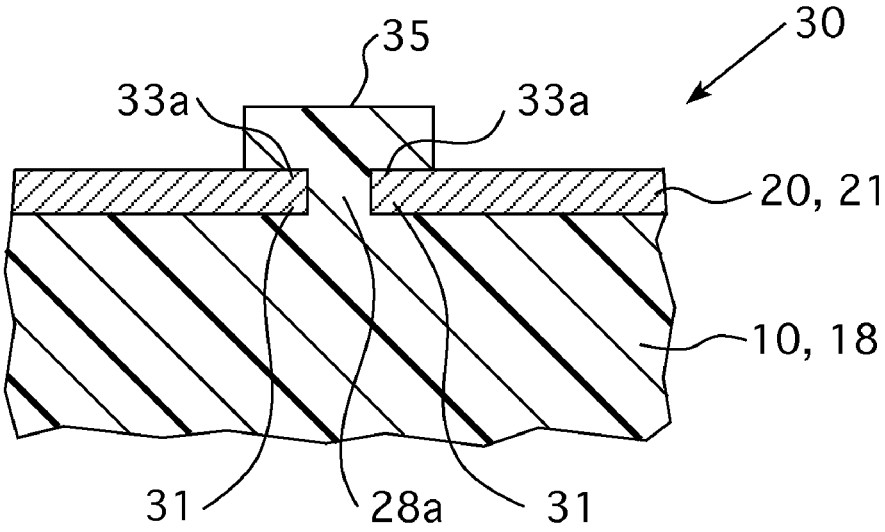
FIG. 6 illustrates a sectional representation of straight perforation edges of a support structure or end cap embedded with a plastic material of a shell with a protruding end cap.
Figure 7:
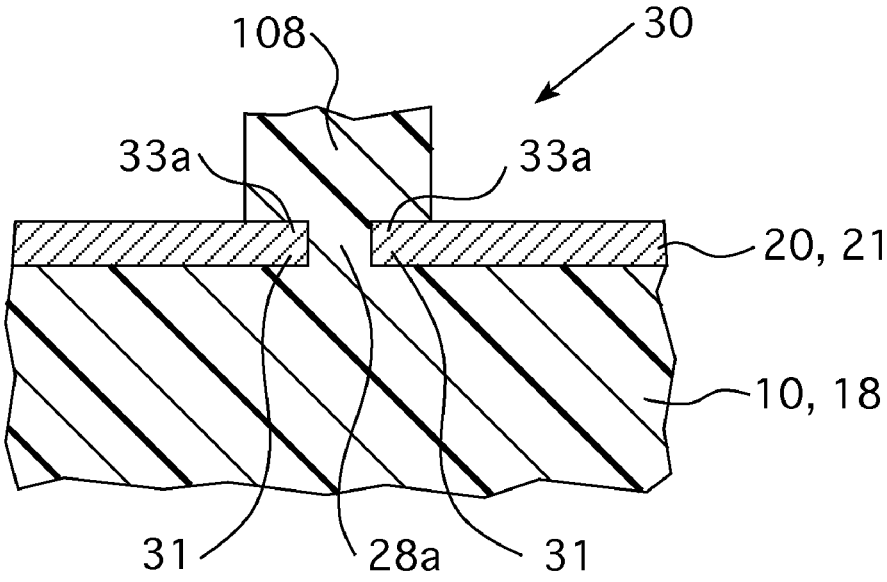
FIG. 7 illustrates a sectional representation of straight perforation edges of a support structure or end cap embedded with a plastic material of a shell with an attachment element that is continuous with a reinforcement rib.
Figure 8:
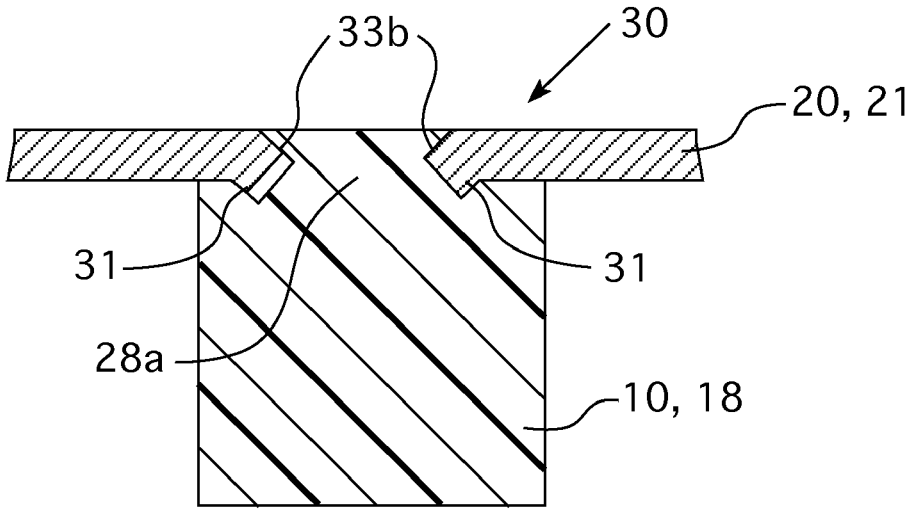
FIG. 8 illustrates a sectional representation of deformed perforation edges of a support structure or end cap embedded with a plastic material of a shell with an attachment element that is flush with the support structure or end cap.
Figure 9:
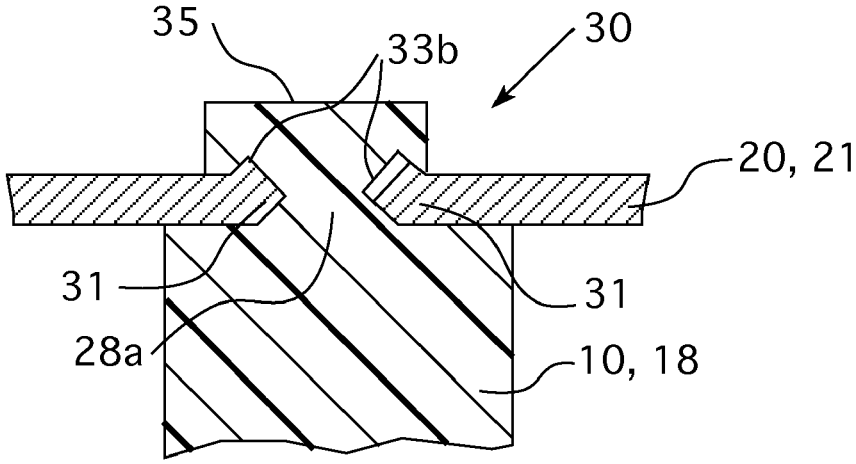
FIG. 9 illustrates a sectional representation of deformed perforation edges of a support structure or end cap embedded with a plastic material of a shell with a protruding attachment element.

In various embodiments, the support structure 20 and/or end cap 21 is provided in close proximity to or joined with the shell 10 and flanged portions of the shell 18 and provide enhanced structural support and dimensional stability to the plastic material of the shell 10. The shell 10 of embodiments may be joined to the support structure 20 and the end cap 21 by molding plastic material of the shell 10 directly onto the support structure 20 and end cap 21, as illustrated in FIG. 4. In embodiments, the plastic material of the shell 10 or the flanged portions of the shell 18 may extend through at least a portion of the perforation in the support structure and end cap 28*a* such that the plastic material substantially fills the perforation covering at least a portion of edges of the perforation and is continuous with an attachment head 30. As illustrated in FIGS. 6, 7, 8 and 9, the attachment head 30 embeds edges 32 of perforation 28*a* in the plastic material and abuts and extends out over 31 an exterior surface of the support structure 20 or the end cap 21. Perforations 28*a* of the support structure 20 and end cap 21 may have any desired configuration, such as, for example, round, square, rectangular, ellipsoid or slotted, and the edges 33 of the perforations 28*a* may be straight 33*a* as illustrated in FIG. 6 and 7 or deformed 33*b* as illustrated in FIGS. 8 and 9. In various embodiments, the attachment head 30 may be flush with the support structure 20 or end cap 21 as illustrated in FIG. 8, or the attachment head 30 may extend past the support structure 20 or end cap 21 forming a plug 35 as illustrated in FIGS. 6 and 9 that may be of any desired shape, such as, for example, cylindrical, rounded, or flat. In particular embodiments, the attachment head 30 may be continuous with one or more reinforcement ribs 108 as illustrated in FIGS. 4, 5, and 7.

In embodiments, the plastic material of the shell may be further molded so as to form a plurality of reinforcement ribs 108 of a plastic material that extends from, and is continuous with the sidewalls 16 of the shell 10. As illustrated in FIG. 4, the reinforcement ribs 108 may extend into the depression for the support structure 12 or to the base of the end cap 23, and the plastic material of the reinforcement ribs 108 may contact the inner edge and/or the outer edge of the support structure. In some embodiments, as illustrated in FIG. 5, the plastic material of the reinforcement rib 108 may extend through one or more perforation 28*a* in the support structure 20 or end cap 21 providing an attachment element 30 that is continuous with the reinforcement rib 108. Additionally, a portion of reinforcement rib 108 in the area around perforation 28*a* in the base 22 of support structure 20 may further abut the interior edge 24 and/or exterior edge 26 of the support structure 20, and may, in some embodiments, be continuous with plastic material of the upper flanged 106 portion of the shell 10 embedding an exterior edge 26 of the support. structure 20. In certain embodiments, a reinforcement rib 108 may extend from an interior edge 24 of the support structure or a sidewall 25 of the end cap 21 to the base 22 of the support structure 20 or the base 23 of the end cap 21 and encompass a plurality of perforations 28*a* in the support structure 20 and/or the end cap 21. Without wishing to be bound by theory, reinforcement ribs 108, including attachment elements 30 and extensions of the shell 10 through the perforation 28*a*, may improve the bond between the plastic material of the shell 10 and the support structure 20 and/or end cap 21 and enhance stability of the sidewalls 16 of the shell 10.

In embodiments as illustrated in FIG. 2, interior reinforcement ribs 112 may be molded into the interior surface 102 of the shell 10 from the top covering 14 and/or the sidewalls 16 of the shell 10, and in some embodiments, an interior reinforcement rib 112 may be continuous with and connect to a sidewall 16 and the top covering 14. Without wishing to be bound by theory, interior reinforcement ribs 112 may provide improved tensile strength and structural rigidity to the cam cover 1, improving the impact strength and dimensional stability of plastic parts of the cam cover 1. In other embodiments, a network of interior reinforcement ribs 112 may be created by connecting interior reinforcement ribs to one another and the interior surfaces 102 of the sidewalls 16 and top covering 14 of the shell 10. A network of interior reinforcement ribs 112 may have any configuration known in the art, such as, for example, parallel configuration (as illustrated in FIG. 2) or a configuration selected from, but not limited to, X-like configurations, zig-zag configurations, curved or arcuate configurations, and combinations thereof. In certain embodiments, arcuate interior reinforcement ribs 112 may be arced toward the top covering allowing the hollow interior of the cam cover to assume a greater volume. In still other embodiments, interior reinforcement ribs 112 may further comprise metal reinforcements embedded in the interior reinforcement ribs 112, and the metal reinforcements may or may not be continuous with the support structure 20 and/or end cap 21.

In some embodiments, another means or combination of means for fixedly attaching the shell 10 to the support structure 20 and/or end cap 21 may be used. In such embodiments, any means for attaching the plastic shell to the material of the support structure 20 and/or end cap 21 may be used. For example, the support structure 20 and/or end cap 21 may be attached to the shell 10 or the flanged portions of the shell 18 using fasteners, adhesives, snap connectors, and the like, or any combination of these. Non-limiting examples of fasteners that may be used to attach the shell 10 to the support structure 20 and/or end cap 21 include screws, such as, sheet metal screws, nuts and bolts, metal rivets, and the like. Adhesives include, but are not limited to, epoxy resin based adhesives, and the like, and snap connectors may be any snap connector known in the art. For example, snap connectors may be formed by pushing an enlarged rounded head of a cylindrical shaft outward from the sidewall 16 of the shell 10 through a matched perforation in support structure 20 and closing the perforation 28*a* back around the shaft, thus fixedly attaching the shell 10 to the support structure 20 or end cap. The rounded head of the cylindrical extension may have a diameter greater than that of the matched perforation and the cylindrical shaft of the extension may have a diameter that is equivalent to the diameter of the perforation 28*a*.

In embodiments as illustrated in FIG. 4, a portion of the perforations 28*b* of the base of the support structure 20 and/or end cap 21 may be continuous with apertures in the flanged portion of the shell 18, and the perforations of the base and the flange apertures may be aligned so as to provide connector apertures 28*b* for the cam cover 1. In an embodiment, the connector aperture 28*b* may further include a collar 32 and/or compression limiter 34 surrounding the connector aperture 28*b* which provides a means by which the shape of the connector aperture is maintained while providing a means of preventing over-compression of the flanged 18 portion of the shell 10 which may result in cracking of the flanged 18 portion of the shell 10 or failure of the flange 18. In some embodiments, a collar 32 and/or a compression limiter 34 may be placed into a mold prior to molding of the shell 10 onto the support structure 20 and/or end cap 21 such that the collar 32 and/or connector apertures 28*b* are formed during molding and the collar 32 and/or compression limiter 34 abut the support structure 20 and/or end cap 21 and at least an outer portion of the collar 32 and/or compression limiter 34 become embedded in the plastic material of shell 10 upon molding. Alternatively, a collar 32 and/or compression limiter 34 may be inserted into a connector aperture 28*b* in the flanged portion of the shell 18 that is formed during the molding and may be attached to the connector aperture 28*b* using adhesives and/or heat, so as to melt a thermoplastic, and/or threads molded into the connector aperture 28*a*.

A plurality of connector apertures 28*b* may be provided throughout the flanged portion 18 of the cam cover 1 and may be aligned with similar apertures on the engine, such that the connector apertures 28*b* and the apertures on the engine supply a means by which the cam cover is attached to the engine. Any connector means known in the art may be used to fixedly attach the cam cover 1 to an engine, including, but not limited to, fasteners, such as, bolts, nuts and bolts, or screws. For example, a bolt may be passed through the connector aperture, and the engine aperture may be machined so as to receive the bolt in such a way so as to fixedly attach the cam cover to the engine, or a bolt may be fixedly attached to the engine, passed through the connector aperture 28*b*, and a nut may be placed onto the bolt, thereby fixedly attaching the cam cover to the engine.

In still other embodiments as illustrated in FIGS. 2 and 5, the lower flanged portion 104 of the shell 10 may further include a gland 110 adjacent to the interior surface 102 of the cam cover 1 and defining an outer perimeter of the hollow interior of the shell 10. A gland 110 may generally consist of a slot molded into the plastic material of the shell 10 and/or the lower flanged portion of the shell 104 and provide a housing for a sealing means 114, such as, for example, a gasket or o-ring. In some embodiments, the gland my further include a reinforcement of a metallic material and or a plastic material having a density greater than that of the shell material pressed into the gland and reinforcing the gland while leaving sufficient space for a gasket or o-ring. The gasket or o-ring of embodiments may be made of any material known in the art, for example, plastic or rubber and the like, or metal. Without wishing to be bound by theory, the gland 110 in combination with a suitable gasket or o-ring 114 may provide a means by which the interior of the cam cover is substantially sealed from the exterior environment of the engine so that materials, such as, for example, oil or lubricant present on the inside of the cam cover 1 is confined to the interior of the cam cover 1 and substances present on the external surface of the cam cover 1, such as, for example, water, dirt, and debris, are substantially prevented from entering into the interior surfaces of the shell 10.

The cam cover 1 of embodiments may further include an insert pressed into the shell 10 or embedded into the plastic of the shell 10. The insert may be made of thin plastic material having a higher density than that of the shell 10 or a thin metal stamped into the shape of the shell, and may generally provide support for plastic structures of the cam cover 1. In embodiments having an insert pressed onto the interior surface of the cam cover, attachment elements 30, as described herein above and in FIGS. 6, 7, 8, and 9, may be used in combination with interior reinforcement ribs to attach the insert to the interior surface of the shell 10.

Sectional representations of attachment elements 30 by which the shell 10 may be fixedly attached to support structure 20, which are formed by the passage of injected-or molded-on plastic material passing through perforations 28*a* and 28*b*, are depicted in FIGS. 6, 7, 8, and 9.

With reference to FIG. 6, an attachment element 30 may include a portion of the shell 10 or flanged portion of the shell 18 that abuts exterior surface the support structure 20 or end cap 21. A portion of the plastic material of the shell 10 or flanged portion of the shell 18 may extend through a perforation 28*a*, is continuous with attachment head or plug 35, and embeds edges 33*a* of perforation 28*a* in the plastic material extending there through. The attachment head 35 may extend out over and abuts interior surface the shell 10 or flanged portion of the shell 18. Attachment head 35 may be of any desired shape, for example, cylindrical, rounded or flat. Perforations 28*a* or 28*b* of the support structure 20 or end cap 21 may have any desired configuration, for example, round, square, rectangular, ellipsoid or slotted.

An attachment element 30 that is continuous with the plastic material of shell 10 and reinforcing ribs 108 of is depicted in FIG. 7. The plastic material of the shell 10 or flanged portion of the shell 18 may abut against exterior surface of the support structure 20 or end cap 21 and extend through a perforation 28*b* and is continuous with reinforcing rib 108. Edges 33*b* of perforation 28*b* may be embedded in the plastic material extending there through. A portion of reinforcing rib 108 in the area around perforation 28*b* may also abut the interior surface the support structure 20 or end cap 21.

Perforations 28*a* and 28*b* in the support structure 20 or end cap 21, through which the plastic material of the shell 10 or flanged portion of the shell 18 extends for the purpose of attaching the shell 10 or flanged portion of the shell 18 to support shell 14 to the support structure 20 or end cap 21 may optionally have deformed edge portions. Such deformed edge portions may be described similarly as those that may be optionally employed in the attachment of reinforcing ribs 17 to support shell 14, as described previously herein with reference to FIGS. 6 and 7.

In FIGS. 8 and 9, the attachment elements 30 include perforations 28*a* having deformed edge portions. With reference to FIG. 8, perforation 28*a* has deformed edges 33*b* that are embedded in the plastic material of the shell 10 or flanged portion of the shell 18 extending there through. The plastic material of the shell 10 or flanged portion of the shell 18 may extend through perforation 28*a* forming flat attachment head 35, which is substantially flush with exterior surfaces of the support structure 20 or end cap 21. With reference to FIG. 9, perforation 28*a* has deformed edges 33*b*, which are embedded in the plastic material of the shell 10 or flanged portion of the shell 18 that extends there through to form attachment head 35 extending out over and abuts interior surface the shell 10 or flanged portion of the shell 18.

In some embodiments, the cam cover 1 may further include an engine component, such as, for example, a sensor or alternator, attached to the plastic of the shell 10. The engine component may be attached to the shell 10 by any means known and utilized in the art, such as, for example, screws or bolts, and in a particular embodiment, the sensor may be attached to the plastic of the shell using self-tapping screws. Without wishing to be bound by theory, the use of self-tapping screws to attach the sensor to the plastic of the shell 10 may allow to the sensor to be placed on the cam cover 1 with enhanced accuracy, for example, within 1/10 mm. At the same time, the use of self-tapping screws may allow for improved dimensional stability, meaning that a sensor or alternator attached to a cam cover may remain within known tolerances throughout use, and/or heating and cooling processes. Accordingly, a sensor may be easily attached to the cam cover 1 of various embodiments within known tolerances of the sensor and remain stably attached within known tolerances overtime.

As used herein and in the claims, the term "thermoset plastic material" means plastic materials having a three dimensional crosslinked network resulting from the formation of covalent bonds between chemically reactive groups, e.g., active hydrogen groups and free isocyanate groups or oxirane groups. Thermoset plastic materials from which the shell 10 and/or the support structure 12 and/or end cap 20 may be fabricated include, for example, crosslinked polyurethanes, crosslinked polyepoxides, and crosslinked polyesters. In particular embodiments, the thermoset plastic material used is crosslinked polyurethanes. The shell 10 and/or support structure 12 and/or end cap 20 may be fabricated by any art-recognized process, such as, for example, injection molding or reaction injection molding. Reaction injection molding typically involves simultaneously injecting into a mold: (i) an active hydrogen functional component such as a polyol and/or polyamine; and (ii) a functional component that forms covalent bonds with the active hydrogen functional component, such as an isocyanate functional component, for example, a diisocyanate such as toluene diisocyanate, and/or dimers and trimers of a diisocyanate such as toluene diisocyanate, The filled mold may be heated to ensure and/or hasten complete reaction of the injected components. Upon complete reaction of the injected components, the mold may be opened and the molded article removed.

As used herein, the term "thermoplastic material" means a plastic material that has a softening or melting point, and is substantially free of a three dimensional crosslinked network resulting from the formation of covalent bonds between chemically reactive groups, e.g., active hydrogen groups and free isocyanate groups. Examples of thermoplastic materials from which the shell 10 and/or the support structure 20 and/or end cap 21 may be fabricated include, but are not limited to, thermoplastic polyurethane, thermoplastic polyurea, thermoplastic polyimide, thermoplastic polyamide, thermoplastic polyamideimide, thermoplastic polyester, thermoplastic polycarbonate, thermoplastic polysulfone, thermoplastic polyketone, thermoplastic polypropylene, thermoplastic acrylonitrile-butadiene-styrene and mixtures or thermoplastic compositions containing one or more thereof.

The plastic material of the shell 10 may be made of a material selected from thermoset plastic materials, thermoplastic materials and combinations thereof. The thermoset plastic materials from which shell 10 may be fabricated include those described previously herein, such as crosslinked polyurethanes. For example, in various embodiments, the plastic of the shell 10 may be a thermoplastic material including, but not limited to, thermoplastic polyurethane, thermoplastic polyurea, thermoplastic polyimide, thermoplastic polyamide, thermoplastic polyamideimide, thermoplastic polyester, thermoplastic polycarbonate, thermoplastic polysulfone, thermoplastic polyketone, thermoplastic polypropylene, thermoplastic acrylonitnile-butadiene-styrene and mixtures or thermoplastic compositions containing one or more thermoplastic. In particular embodiments, the shell 10 may be fabricated from thermoplastic polyamide, such as, for example, DURETHAN® thermoplastic polyamide, commercially available from LANXESS Corporation. In general, the plastic material of the shell may maintain consistent strength and/or rigidity throughout a temperature range from about −40° C. to about 150° C. and may be chemically resistant to various fluids, such as, for example, water, fuels, engine oil, lubricants, and salt.

The shell 10 may be reinforced with a material selected from glass fibers, carbon fibers, metal fibers, polyamide fibers and mixtures thereof, and in certain embodiments, the reinforcing material used in the shell 10 is glass fibers. Reinforcing fibers may be surface treated by any method known in the art, such as, for example, with sizings, to improve miscibility and/or adhesion to the plastics into which they are incorporated prior to incorporation into the plastic material shell 10. Reinforcement materials may be present in the thermoset plastic materials and/or thermoplastic materials of the shell 10 in any amount known to produce a reinforcing effect, such as, for example, from about 5% by weight to about 60% by weight based on the total weight of the shell 10.

The plastic materials used in the shell 10 may further include one or more functional additives other than, or in addition to, reinforcing materials including, but not limited to, antioxidants, colorants, such as pigments and dyes, mold release agents, fillers, such as, carbon black, metals, calcium carbonate, and the like, ultraviolet light absorbers, fire retardants, and the like, and mixtures thereof. Additives in the plastic material of the shell 10 may be present in functionally sufficient amounts known in the art. For example, individual additives may be from about 0.1% by weight to about 10% by weight, based on the total weight of the plastic material of the shell 10.

Support structure 20 and end cap 21 may be fabricated from a metal material or a plastic material, such as, thermoset plastic, thermoplastic, and the like, or combinations of metal and plastic materials. Thermoset plastics and thermoplastics may include but not be limited to any of the materials recited herein above with regard to the shell 10 and may contain reinforcing materials and/or additives described in relation to the shell 10. In particular embodiments, support structure 20 and end cap 21 are fabricated from metal materials including, but not limited to, titanium, steel, aluminum, titanium alloys, ferrous alloys, aluminum alloys, and the like, and combinations thereof. In embodiments where the support structure and/or end cap is fabricated from metal, the support structure 20 and/or end cap 21 may further include a layer of molded-on plastic or wax, which may protect the support structure 20 and/or end cap 21 from environmental effects, such as corrosion.

The plastic material of reinforcement ribs 108 may be selected from thermoset plastic materials and thermoplastic materials described herein above with regard to the shell 10 and may be reinforced with a material selected from glass fibers, carbon fibers, metal, polyimide fibers, and mixtures thereof. The reinforcement materials may be treated, for example, with sizings as discussed herein above and may be present in any amount known to provide the desired effect. For example, reinforcement materials may be present in an amount of from about 5% by weight to about 60% by weight, based on the total weight of reinforcement ribs 108. The plastic material of reinforcement ribs 108 may further contain one or more additives in addition to, or other than, the reinforcing materials, and such additives may be present in the plastic material of reinforcement ribs 108 in an amount as recited previously herein with regard to the shell 10.

The cam cover 1 described herein may be made by fabricating a support structure 20 and end cap 2.1 from a suitable material, such as, for example, by stamping or pressing a metal sheet or by molding a thermoplastic or thermoset material into the proper shape. The support structure 20 and end cap 21 may the be placed into a mold, and the plastic material of the shell 10 may be molded onto the support structure 12 by, for example, injection molding. In various embodiments, the plastic material of shell 10 may be molded onto at least a portion of an interior surface of the support structure 20 and/or end cap 21 while at least a portion of an exterior surface of the support structure and/or end cap 21 is substantially free of the molded plastic. Reinforcement ribs 108 may be molded concurrently onto exterior surfaces of the support structure 20 and/or end cap 21, and at least a portion of the exterior edges 26 and interior edges 24 of the support structure 20 and the end cap edges 27 may be embedded in the plastic material of the shell. Reinforcement ribs 108 and edges of the support structure 20 and/or end cap 21 may, therefore, be continuous with, and made from the same material as the shell 10. In other embodiments, reinforcement ribs 108 may be formed in an additional step and/or edges of the support structure 20 and/or end cap 21 may be embedded either prior to or after molding of the shell 10. For example, a support structure 20 and/or end cap 21 with reinforcement ribs 17 fixedly held to the support structure 20 and/or end cap 21, may be placed into a mold and the plastic material of the shell 10 may be injected and molded onto and concurrently fixedly attached to the support structure 12 and/or end cap 20 and reinforcement ribs 30. Or, reinforcement ribs 30 may be molded onto exterior surfaces of the support structure 12 and/or end cap 20 after the shell 10 has been molded onto and fixedly attached to the support structure 12 and/or end cap 20.

The cam covers described herein, and illustrated in the attached figures, are not limited to cam covers of any particular size, shape, or configuration. Accordingly, cam covers embodied in the present invention may be configured or designed to accommodate any engine type known in the art.

Although the present invention has been described in considerable detail with reference to certain preferred embodiments thereof, other versions are possible. Therefore the spirit and scope of the appended claims should not be limited to the description and the preferred versions contained within this specification.

What is claimed is:

1. A cam cover comprising:

a shell of a plastic material selected from thermoset plastic, thermoplastic, and combinations thereof having a top cover and sidewalls extending substantially downward from the top cover, wherein the shell has an exterior surface and an interior surface, said interior surface defining a hollow interior having an open bottom opposite the top cover;

a support structure comprised of a metallic material and comprising a base, inner edges, outer edges, and at least one perforation; and wherein at least a portion of the shell extends through the at least one perforation of the support structure whereby at least a portion of the shell is fixedly attached to at least a portion of the support structure, at least one sensor, wherein said sensor is disposed on the shell, and wherein the cam cover maintains a consistent rigidity throughout a temperature range from −40° C. to 150° C.

2. The cam cover of claim 1, wherein at least a portion of the inner edges, outer edges, or combination thereof of the support structure are embedded in the shell.

3. The cam cover of claim 1, wherein the shell is further fixedly attached to the support structure by fasteners, adhesives, snap connectors, or combinations thereof.

4. The cam cover of claim 1, wherein the plastic material of the shell further comprises a reinforcement material selected from glass fibers, carbon fibers, metal fibers, polyamide fibers, and mixtures thereof.

5. The cam cover of claim 1, wherein the shell further comprises a flanged portion having a lower flange and an upper flange, said lower flange extending substantially laterally from the sidewalls and providing a means by which the cam cover attaches to an engine, and said upper flange extending substantially laterally from the sidewalls of the shell and being continuous with the lower flange and abutting the support structure.

6. The cam cover of claim 5, wherein the support structure is further fixedly attached to the upper flange.

7. The cam cover of claim 5, wherein the interior surface of the shell and an outer surface of the lower flange are continuous.

8. The cam cover of claim 5, wherein the lower flange further comprises a gland and a sealing means.

9. The cam cover of claim 8, wherein the sealing means comprises a gasket or o-ring in the gland.

10. The cam cover of claim 5, wherein the flanged portion further comprises at least one flange aperture wherein the at least one perforation is aligned with the at least one flange aperture to make a connector aperture; and wherein the connector aperture is continuous with engine apertures on the engine.

11. The cam cover of claim 10, wherein at least a portion of the connector aperture further comprises a compression limiter.

12. The cam cover of claim 1, wherein the shell further comprises at least one reinforcement rib dispersed on or around an exterior surface of the sidewalls, the at least one reinforcement rib being continuous with the sidewalls and extending substantially downward and laterally to the support structure.

13. The cam cover of claim 12, wherein at least a portion of the shell extends through the at least one perforation of the support structure thereby connecting the shell to the at least one reinforcement rib of the shell.

14. The cam cover of claim 1, wherein the sensor and/or alternator is fixedly attached to the cam cover by self tapping screws screwed into the shell.

15. The cam cover of claim 1, further comprising an insert pressed onto the interior surface of the shell.

16. The cam cover of claim 1, wherein the interior surface of the shell further comprises one or more interior reinforcement ribs, said interior reinforcement ribs being continuous with at least a portion of the shell.

17. An engine comprising:

an engine having cams, rockers and/or valves; and the cam cover according to claim 1 covering the cams, rockers and/or valves.

18. An automobile comprising:

an engine having cams, rockers and/or valves; and the cam cover according to claim 1 covering the cams, rockers and/or valves.

* * * * *